US007954677B2

(12) United States Patent
Langlois et al.

(10) Patent No.: US 7,954,677 B2
(45) Date of Patent: Jun. 7, 2011

(54) PUMP FOR DISPENSING A DOSE OF A FLUID PRODUCT AND RANGE COMPRISING SUCH PUMPS

(75) Inventors: Yohann Langlois, Feuquieres en Vimeu (FR); Christophe Roy, Dieppe (FR)

(73) Assignee: Rexam Dispensing Systems, S.A.S. (FR)

( * ) Notice: Subject to any disclaimer, the term of this patent is extended or adjusted under 35 U.S.C. 154(b) by 477 days.

(21) Appl. No.: 12/018,269

(22) Filed: Jan. 23, 2008

(65) Prior Publication Data

US 2008/0210713 A1 Sep. 4, 2008

(30) Foreign Application Priority Data

Jan. 23, 2007 (FR) ..... 07 00462

(51) Int. Cl.
*B65D 88/54* (2006.01)

(52) U.S. Cl. ..... 222/321.9; 222/385

(58) Field of Classification Search .... 222/321.7–321.9, 222/321.1, 321.2, 385, 383.1
See application file for complete search history.

(56) References Cited

U.S. PATENT DOCUMENTS

| | | | | |
|---|---|---|---|---|
| 2,593,591 A | | 4/1952 | Menkin et al. | |
| 3,583,605 A | * | 6/1971 | Corsette | 222/321.9 |
| 5,083,682 A | * | 1/1992 | Cater | 222/321.2 |
| 5,725,128 A | * | 3/1998 | Foster | 222/153.13 |
| 6,196,424 B1 | * | 3/2001 | Bougamont et al. | 222/321.9 |
| 6,364,181 B1 | * | 4/2002 | Garcia et al. | 222/634 |
| 6,398,079 B1 | * | 6/2002 | Garcia et al. | 222/190 |
| 7,108,160 B2 | * | 9/2006 | Moretti | 222/321.7 |
| 2003/0116588 A1 | | 6/2003 | Santagiuliana | |
| 2004/0149777 A1 | | 8/2004 | Santagiuliana | |
| 2007/0045349 A1 | * | 3/2007 | Foster et al. | 222/321.9 |

FOREIGN PATENT DOCUMENTS

| | | | | |
|---|---|---|---|---|
| EP | 1266696 A1 | | 12/2002 | |
| GB | 2231096 | * | 11/1990 | 222/321.9 |
| WO | 0178903 A1 | | 10/2001 | |
| WO | 2006008597 A1 | | 1/2006 | |

OTHER PUBLICATIONS

French Search Report, Jul. 20, 2007, 2 Pages.

* cited by examiner

*Primary Examiner* — Lien T Ngo
(74) *Attorney, Agent, or Firm* — St. Onge Steward Johnston & Reens LLC

(57) ABSTRACT

Pump for dispensing a dose of a fluid product, comprising a tubular body including an intake orifice; an end member associated with the body and including a rest abutment and an end-of-stroke abutment; a compression member mounted so as to move inside the body between a rest position in which said compression member is in abutment against the rest abutment, and an end-of-stroke position in which said compression member is in abutment against the end-of-stroke abutment, said compression member being elastically returned toward the rest position and including an exhaust orifice; a metering chamber; and an intake valve and an exhaust valve adapted to selectively close off the intake orifice and the exhaust orifice, respectively.

4 Claims, 2 Drawing Sheets

PUMP FOR DISPENSING A DOSE OF A FLUID PRODUCT AND RANGE COMPRISING SUCH PUMPS

CROSS-REFERENCE TO RELATED APPLICATIONS

The present application claims priority of French patent application No. 07 00462 filed on Jan. 23, 2007, the content of which is incorporated herein by reference.

FIELD OF THE INVENTION

The invention relates to a pump for dispensing a dose of a fluid product and also to a range comprising such pumps.

BACKGROUND OF THE INVENTION

More particularly the invention relates to a pump for dispensing a dose of a fluid product, comprising: a tubular body extending along a central axis between a first end and a second end and including an intake orifice near the first end; an end member having a central opening and associated with the second end of the body, the end member having a tubular wall that extends along the central axis and has an outer surface and an inner surface, the end member including a rest abutment and an end-of-stroke abutment; compression member mounted so as to move inside the body along an axial stroke between a rest position, away from the intake orifice and in which said compression member is in abutment against the rest abutment, and an end-of-stroke position, close to the intake orifice and in which said compression member is in abutment against the end-of-stroke abutment, said compression member being elastically returned toward the rest position and including a stem extending in the central opening of the end member, a piston sliding inside the body and an exhaust orifice; a metering chamber formed between the intake orifice and the exhaust orifice and delimited by the body and the compression member; and an intake valve and an exhaust valve adapted to selectively close off the intake orifice and the exhaust orifice, respectively.

Document WO-2006/008597 describes a pump of this type in which the end member is provided with a groove for limiting the stroke of the compression member.

However, in such a pump, the compression member may be angularly offset relative to the central axis, causing a lack of sealing between the piston and the body and also a risk of premature wear of the piston.

SUMMARY OF THE INVENTION

The invention aims to alleviate the abovementioned problems.

For this purpose, the invention proposes a pump of the aforementioned type in which the end-of-stroke abutment is formed by a shoulder provided on the inner surface of the end member, the stem having a collar that can move in the end member facing the inner surface of said end member, the collar being adapted to be in abutment against the shoulder in the end-of-stroke position.

Thus, the collar guides the stem in the end member when the compression member is moved along the stroke. In addition, in the end-of-stroke position, the bearing of the collar on the shoulder is distributed uniformly within the end member. The compression member extends along the central axis at all steps in the operation of the pump, thereby ensuring that the piston bears in a distributed manner on the body. Sealing between the piston and the body may thus be provided and the wear of the piston may be limited.

In particular embodiments, the pump may have, optionally in a complementary manner, one or more of the following arrangements:

- the stem is adapted to be in abutment directly against the end-of-stroke abutment in the end-of-stroke position;
- the end member includes a tubular skirt fitted inside the body and having a free end that forms the rest abutment, the piston being in abutment directly against the free end of the skirt in the rest position: the free end of the skirt can then form a substantial part of the end member making it possible to seal between the piston and the end member in the rest position; the pump as defined above makes it possible to avoid modifying this part of the end member and avoid particularly precise and delicate adaptation, development and control of the machines for producing this part; and
- the skirt includes an axial end zone that has the free end and is radially offset toward the inside of the body, the piston having an annular groove in which the end zone is placed in sealed contact in the rest position.

The object of the invention is also to allow a range of pumps to be produced in a simple manner, in which the pumps, having similar components, materials, technical features and operation, can dispense doses of a fluid product of different volume.

For this purpose, the invention also proposes a range of pumps comprising at least first and second pumps as defined above, said first and second pumps being designed to dispense doses of the fluid product and having different first and second volumes respectively, the respective end-of-stroke abutments of the end member of the first and second pumps being located at first and second distances from the intake orifice respectively, said first and second distances being different from each other.

Each pump of such a range is adapted to dispense a dose of a fluid product having a defined volume. The end member forms a single module making it possible for the volume of the dose to be dispensed to be adjusted in such a way as to reduce the number of manufacturing operations and to limit the modification of the production machines which is needed to vary the volumes of the dose to be dispensed by the pumps of one and the same range.

BRIEF DESCRIPTION OF THE DRAWINGS

Other objects and advantages of the invention will become apparent on reading the following description, given with reference to the appended drawings in which.

DETAILED DESCRIPTION OF THE INVENTION

Figure 1:
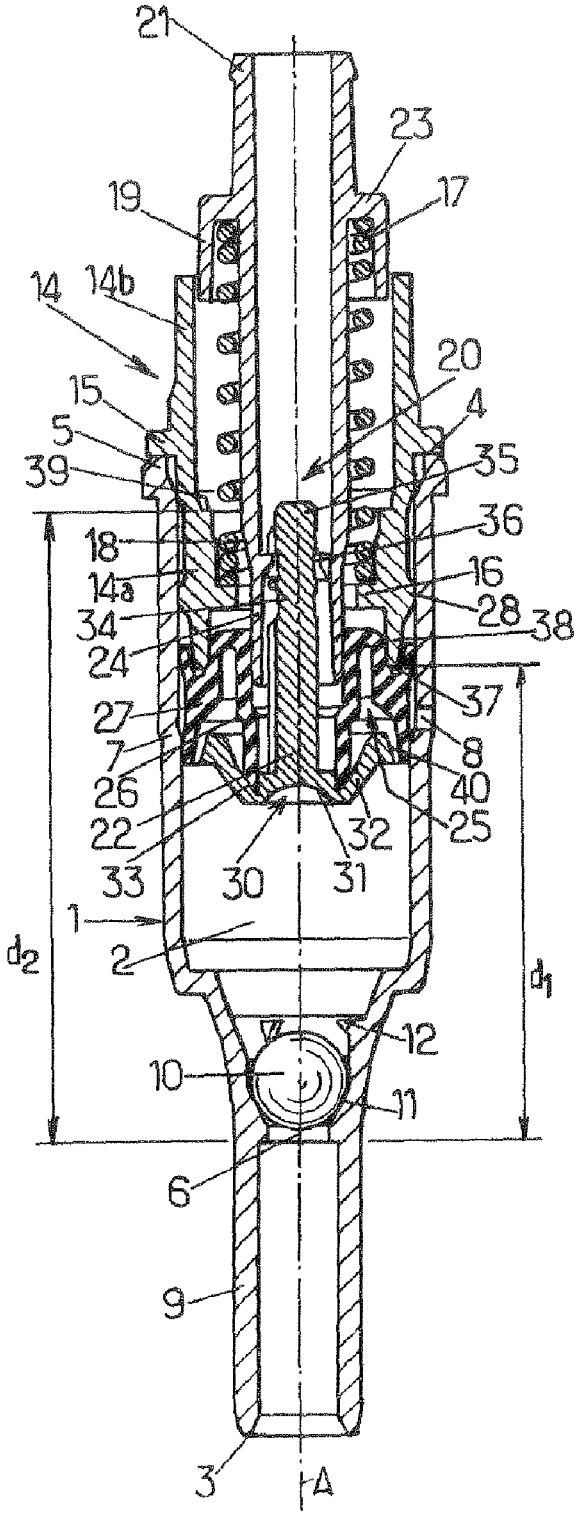
FIG. 1 is a longitudinal sectional representation of a pump in a rest position according to one embodiment of the invention, said pump being designed to dispense a dose of a fluid product having a first volume.

In the figures, the same references denote identical or similar elements.

The figures show one particular embodiment of a pump for dispensing a dose of a liquid or viscous fluid product, for example in the field of perfumery, pharmacy, cosmetics or the like.

The pump may belong to a range of pumps, in which range pumps having similar components, materials, technical features and operation are designed to dispense doses of a fluid product having different volumes.

The pump comprises:

a tubular body 1 extending along a central axis A between a first end 3 and a second end 4 and having an intake orifice 6 for the fluid product near the first end 3; and a compression member mounted so as to move inside the body 1 along an axial stroke between a rest position, away from the intake orifice 6 (FIGS. 1 and 3), and an end-of-stroke position, near the intake orifice 6 (FIGS. 2 and 4), the compression member having an exhaust orifice.

The pump is intended to be placed via the first end 3 of the body 1 in an opening in a reservoir (not shown) and fastened in a manner known per se, for example by press-fitting and/or by means of a fastening member, to the reservoir so as to be able to withdraw a dose of the fluid product contained in the reservoir.

In the rest of the description, the terms "upper" or "top" and "lower" or "bottom" will be understood to mean in relation to places located near the second end 4 of the body 1 and near the first end 3 of the body 1, respectively. Moreover, the terms "axial" or "longitudinal" and "radial" or "transverse" refer to planes parallel and perpendicular to the central axis A, respectively.

The body 1 and the compression member delimit a metering chamber 2 formed between the intake orifice 6 and the exhaust orifice. The compression member can then move inside the body 1 along the stroke so that, by varying the volume of the metering chamber 2, it is possible to alternately make fluid product enter the metering chamber 2 via the intake orifice 6 and make the fluid product leave the metering chamber 2 via the exhaust orifice.

The body 1 has an annular lateral wall 7 in which the compression member is mounted. The lateral wall 7 has an inner surface, an outer surface, a lower end and an open upper end having an annular rim 5 projecting outward and forming the second end 4 of the body 1.

A through-hole forming a vent hole 8 may be provided in the lateral wall 7 so as to allow air to pass between the outside and the inside of the reservoir in order to compensate for the dose of fluid product withdrawn by the pump.

The particular embodiment shown provides for the body 1 to also be able to have an annular lower wall 9 that extends from the lower end of the lateral wall 7 and the free end of which forms the first end 3 of the body 1, that is to say the lower end.

The lower wall 9 includes, on the inside, the intake orifice 6 and an intake valve, for example a ball valve having a ball 10 and a seat 11, designed to allow the intake orifice 6 to be selectively closed off, that is to say it is open when the ball 10 is away from the seat 11 or closed when the ball 10 rests on the seat 11. Abutment members 12 may be provided facing the seat 11 and at a certain distance therefrom, in order to form a cage that limits the movements of the ball 10.

The lower wall 9 may for example house, by press fitting, a dip tube (not shown) for bringing the metering chamber into communication with the reservoir.

However, the invention is not limited in particular to a body 1 or an intake valve such as those described above. For example, it is possible for the body 1 not to have a lower wall 9, the lower end of the lateral wall 7 forming the first end 3 of the body 1, or to include a lower wall surrounded by the lateral wall 7, the intake valve and the intake orifice 6 being adapted accordingly.

The pump furthermore includes an end member 14 having a central opening and associated with the upper end 4 of the body 1.

To close the upper end 4 of the body 1 and to guide the compression member translationally along the central axis A, the end member 14 may have a tubular wall that extends along the central axis A. The end member 14 then has an outer surface and an inner surface that defines the central opening.

In particular, the tubular wall of the end member 14 may form a lower tubular skirt **14*a* press-fitted into the body 1. The outer surface of the skirt 14*a* may then be placed at least locally in contact with the inner surface of the lateral wall 7 of the body 1. For example, an annular boss 28 may be provided on the outer surface of the skirt 14*a* so as to come into contact with the inner surface of the body 1 and allow the end member 14 to fastened inside the body 1. Moreover, a shoulder 15 projecting radially outward may be provided at one end of the skirt 14*a* in order to rest on the rim 5 of the body 1**.

The skirt **14*a* may then have a free end 37, opposite the shoulder 15, which may be away from the inner surface of the body 1. In particular, the skirt 14*a* may include an axial end zone 38 which includes the free end 37 and is radially offset relative to the central axis A toward the inside of the body 1. An annular space may thus be formed between the inner surface of the body 1 and the outer surface of the end zone 38 of the skirt 14*a***.

To make it easier to introduce the skirt **14*a* of the end member 14, the inner surface of the lateral wall 7 of the body 1 may for example be adapted to have an enlarged part at the upper end 4 and a narrower part against which the skirt 14*a*** is press-fitted, an inclined portion joining the two parts.

In other embodiments, provision is made for the end member 14 to be associated with the second end 4 of the body 1 by any other means and the end member 14 may be associated with the outer surface of the lateral wall 7 of the body 1.

In the figures, the tubular wall of the end member 14 may also form an upper tubular sleeve **14*b* that projects from the upper end 4 of the body 1**.

The compression member comprises:

a stem 20 lying in the central opening of the end member 14; and a piston 25 sliding inside the body 1.

In the embodiment shown, the stem 20 may comprise an elongated axial actuating tube 21 which defines an output duct for taking the fluid product from the metering chamber 2 to the outside.

The actuating tube 21 lies inside the end member 14 and has an open lower end, placed inside the body 1 and located near the intake orifice 6, and an open upper end, located at some distance from the intake orifice 6 and projecting from the upper end 4 of the body 1.

The upper end of the actuating tube 21 may be adapted to allow an actuating member, such as a pusher (not shown), to be fastened, on which member a user may exert pressure in order to actuate the pump, moving the stem 20 from the rest position to the end-of-stroke position.

Furthermore, provision may be made for the stem 20 to be elastically returned to the rest position.

To do this, the actuating tube 21 may have an annular flange 23 that extends radially outward. An elastic member, for example a compression spring 17, may then extend between the flange 23 of the actuating tube 21 and a radial projection 16 that extends from the inner surface of the end member 14 inward, approximately opposite the boss 28.

The compression spring 17 thus placed around the actuating tube 21 on the outside of the metering chamber 2 makes it possible to make the pump more compact and to avoid any contact between the fluid product and the compression spring 17. However, as a variant, any other suitable arrangement of the compression spring 17 may be provided, especially on the outside of the end member 14, or any other type of elastic member.

Figure 2:
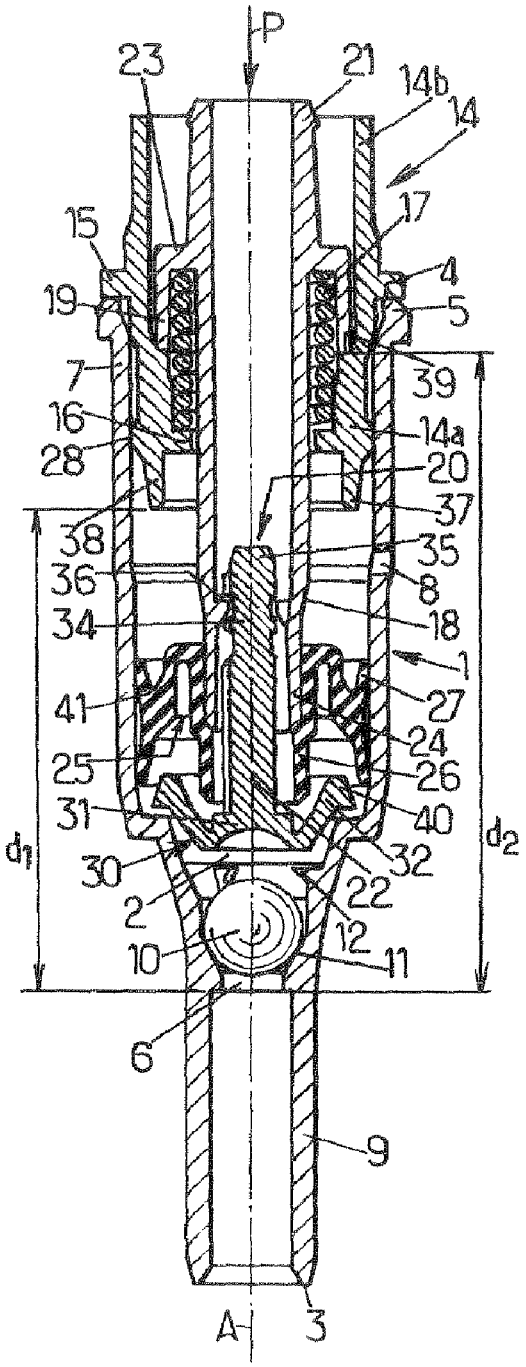
FIG. 2 is a longitudinal sectional representation of the pump of FIG. 1 in an end-of-stroke position.
Figure 3:
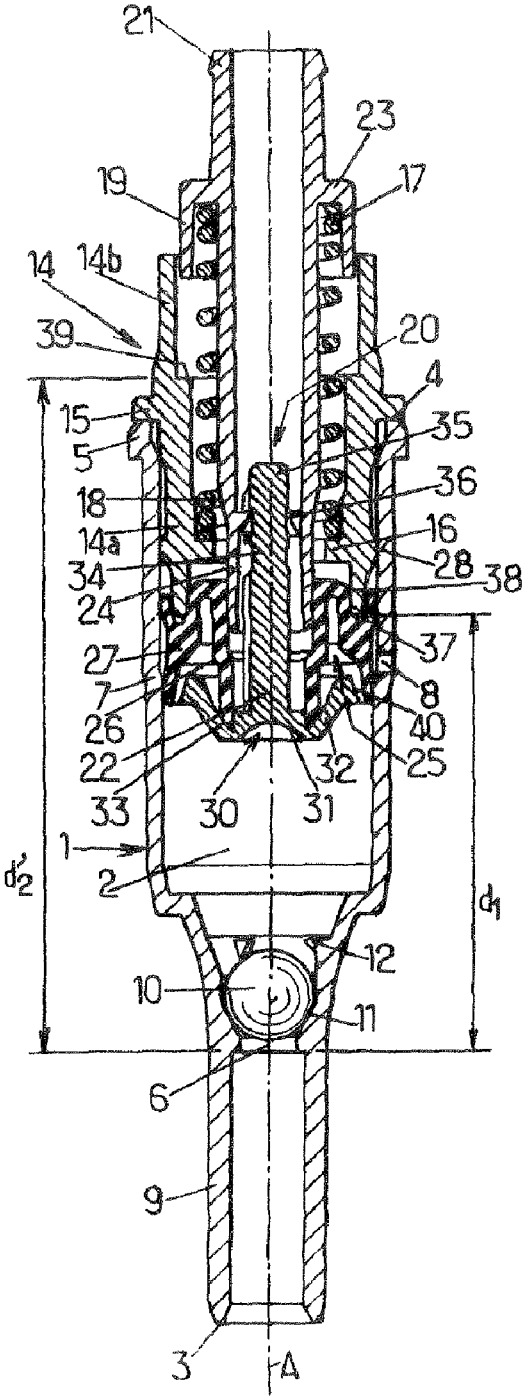
FIG. 3 is a longitudinal sectional representation of a pump similar to that of FIG. 1 in the rest position, said pump being designed to dispense a dose of a fluid product having a second volume, different from the first volume.
Figure 4:
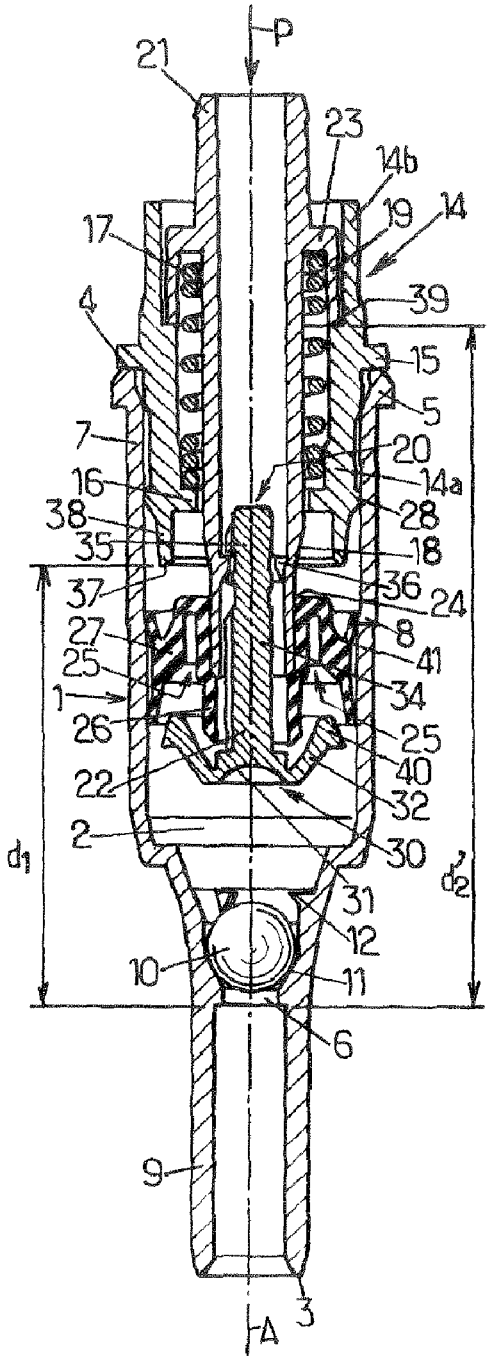
FIG. 4 is a longitudinal sectional representation of the pump of FIG. 3 in the end-of-stroke position.

To define the axial stroke of the compression member, the pump furthermore has:

a rest abutment against which the compression member is in abutment in the rest position, as shown in FIGS. 1 and 3; and an end-of-stroke abutment against which the compression member is in abutment in the end-of-stroke position, as shown in FIGS. 2 and 4.

In particular, provision may be made for the end member 14 to have the rest abutment and the end-of-stroke abutment.

Provision may especially be made for the free end 37 of the skirt 14*a* to form the rest abutment against which the piston 25 is in abutment directly in the rest position of the compression member.

Moreover, the end-of-stroke abutment may be provided, for example in the form of a shoulder 39, on the inner surface of the end member 14. The stem 20 may then be designed so as to be in abutment directly against the shoulder 39 in the end-of-stroke position. The shoulder 39 constitutes an annular projection on the inner surface of the tubular wall of the end member.

The rest abutment is then located between the end-of-stroke abutment and the lower end 3 of the body. The axial stroke of the compression member is defined by the difference between, on the one hand, the distance of those parts of the piston 25 and of the stem 20 that are intended to be in abutment on the rest and end-of-stroke abutments and, on the other hand, the distance between the free end 37 and the shoulder 39 of the end member 14.

In order for it to be possible for the end member 14 to have the same size and for the skirt 14*a* to have the same height irrespective of the volume of the dose to be dispensed, provision may be made for the rest and end-of-stroke abutments to be located at a first distance d1 and a second distance d2 from the intake orifice 6, respectively, the first distance d1 being fixed irrespective of the volume of the dose to be dispensed and the second distance d2 being designed to be varied so as to define a volume for the dose.

All the pumps of one and the same range dispensing doses of different volumes may thus have one and the same rest position, thereby simplifying production of the member for housing the upper part of the pump and the actuating member, which members may be the same for all the pumps. Furthermore, the free end 37 of the skirt 14*a* may in particular be designed to seal between the piston 25 and the end member 14, in the rest position, without having to be modified and adjusted from one pump to another.

For example, FIGS. 1 and 2 show a first pump designed to dispense doses of a fluid product having a first volume. The free end 37 of the end member 14 is located at a distance d1 from the intake orifice 6 and the shoulder 39 is located at a distance d2 from the intake orifice 6. The shoulder 39 may then be located on the inner surface of the skirt 14*a*.

In FIGS. 3 and 4, a second pump belonging to the same range as the first pump is designed to dispense doses of a fluid product having a second volume different from the first volume, for example smaller than the first volume. The free end 37 of the end member 14 is located at the same distance d1 from the intake orifice 6 as that of the first pump, but the shoulder 39 is located at a different distance d2' from the intake orifice 6, for example a larger distance, from that of the first pump. The shoulder 39 may then be on the inner surface of the sleeve 14*b*.

To guide the actuating tube 21 translationally along the central axis A, the actuating tube 21 may include a collar 19 that extends axially from the free end of the flange 23 of the actuating tube 21 so as to be able to be in abutment against the annular shoulder 39 in the end-of-stroke position. In the end-of-stroke position, the collar 19 may thus bear on the shoulder 39 so as to be uniformly distributed over an annular zone of the end member 14. The actuating tube 21 is maintained along the axis A, thereby ensuring distributed bearing between the piston 25 and the body 1.

The collar 19 that surrounds part of the actuating tube 21 has an external transverse dimension substantially equal to or less than the internal transverse dimension of part of the inner surface of the end member 14 so as to be able to move, in particular together with the actuating tube 21, in the end member 14 facing the inner surface of said end member 14.

In the embodiment shown, the collar 19 is made as one piece with the actuating tube 21. As a variant, it is however possible for the collar 19 and/or the flange 23 to be attached thereto. Moreover, it is also possible to provide for the position on the stem 20 and/or the length of the collar 19 to be able to be varied, so as to vary the stroke of the compression member and the volume of the dose of fluid product to be dispensed.

Moreover, it may be seen in the figures that the stem 20 may also include an elongate insert 22 joined to the actuating tube 21. The insert 22 may have a base 30 that extends generally transversely relative to the central axis A and is placed inside the metering chamber 2 facing the intake orifice 6. For example, the base 30 may have an upwardly turned concavity and include a central part 31 and an upwardly flaring frusto-conical peripheral collar 32.

The insert 22 and the actuating tube 21 together define one or more passages, forming the exhaust orifice, for the fluid product to be taken from the metering chamber 2 to the output duct.

The piston 25 may then be mounted so as to slide axially on the stem 20 and include annular sealing bearing surfaces for coming into sealed contact with annular sealing bearing surfaces formed on the base 30, and thus form an exhaust valve 33 selectively closing off the exhaust orifice when the piston 25 is sliding on the stem 20.

The actuating tube 21 may have, near the lower end, an end portion 24 of smaller transverse dimension. The end portion 24 on which the piston 25 is mounted so as to slide may for example be upwardly bounded by a shoulder or a flared portion 18.

To allow the piston 25 to be mounted on the stem 20 having, on the one hand, the flange 23 and the flared portion 18 on the actuating tube 21 and, on the other hand, the base 30 on the insert 22, the actuating tube 21 and the insert 22 may be two separate components assembled after the piston 25 has been mounted on the actuating tube 21. In particular, the insert 22 may be inserted into the open end of the actuating tube 21.

Moreover, since the flange 23 is made as one piece with the actuating tube 21, the end portion 24 of the actuating tube 21 is inserted into the end member 14 via the central opening of the sleeve 14*b* prior to the piston 25 and the insert 22 being assembled and prior to the end member 14 being mounted on the body 1 of the pump. As indicated above, the flange 23 and the collar 19 may however be attached, the end member 14 then being able to be mounted after the piston 25 and the insert 22 have been assembled.

In order for the relative positions of the insert 22 and the actuating tube 21 to be able to ensure uniform sealed contact between the sealing bearing surfaces of the base 30 and of the piston 25 and satisfactory bearing of the piston 25 on the body 1 of the pump, a ball and socket joint may be provided between the insert 22 and the actuating tube 21.

In particular, the insert 22 may have a rod 34 that extends from the central part 31 of the base 30 approximately perpendicular to the latter. The rod 34 may have a free end, opposite the base 30, provided with a head 35 snap-fastened onto an annular rim 36 formed inside the actuating tube 21, both axial clearance and transverse clearance being provided between the insert 22 and the actuating tube 21.

In other embodiments, the insert 22 may have a hollow rod 34 that defines a lower part of the output duct and the exhaust orifice may be provided transversely on the actuating tube 21 or, as the case may be, on the hollow rod.

The piston 25 is designed to bear in a sealed manner against the inner surface of the lateral wall 7 of the body 1 and in contact with the sealing bearing surfaces of the base 30.

In particular, the piston 25 may include a central sleeve 26 mounted so as to slide on the end portion 24 of the actuating tube 21 between the flared portion 18 and the base 30, the distance between the flared portion 18 and the base 30 being designed to open the exhaust valve 33 sufficiently. As a variant, in the case in which the insert 22 comprises a hollow rod 34, the piston 25 could be mounted on the insert 22.

The central sleeve 26 may have a lower free end that extends into the concavity of the base 30 so as to define the sealing bearing surfaces coming into contact with the sealing bearing surfaces of the base 30. The sealing bearing surfaces of the base 30 may thus be located on either side of the free end of the sleeve 26 so as to improve the sealing of the exhaust valve 33.

The piston 25 may also include an axial annular bushing 27 surrounding the central sleeve 26 and connected to the latter via a substantially radial wall. The bushing 27 may define an upper lip and a lower lip which come into rubbing contact with the inner surface of the lateral wall 7 of the body 1, the vent hole 8 being placed between the upper and lower lips in the rest position.

To improve the sealing between the end member 14 and the piston 25 in the rest position, the piston 25 may have an annular groove 41, for example formed between the upper lip and the central sleeve 26, in which groove the end zone 38 of the skirt 14*a* is placed in sealed contact in the rest position.

The actuation of the pump by the user, in order to dispense a dose of fluid product, will be described in relation to the figures.

In the absence of an external force, the stem 20 urged by the compression spring 17 is in its rest position (FIGS. 1 and 3). The piston 25 is in abutment against the free end 37 of the skirt 14*a* of the end member 14, sealed contact being established between the end zone 38 of the skirt 14*a* and the piston 25. The free end of the central sleeve 26 rests against the base 30 so as to close the exhaust valve 33. Moreover, the intake valve is closed.

In the embodiments shown, provision is made for the frictional force between the piston 25 and the body 1 to be greater than the frictional force between the piston 25 and the stem 20. When the user exerts a pressure P, for example via the pusher, on the actuating tube 21, owing to the difference between the frictional forces the actuating tube 21 slides relative to the piston 25 so as to open the exhaust valve 33. For example, the actuating tube 21 can slide relative to the piston 25 until the lower end of the actuating tube 21 is in abutment against a narrowing of the central sleeve 26 or until the shoulder or the flared portion 18 of the actuating tube 21 is in abutment against the central sleeve 26.

Next, the displacement of the actuating tube 21 causes the displacement of the piston 25 toward the intake orifice 6. The displacement of the stem 20 may be continued until the collar 19 is in abutment against the annular shoulder 39. The compression member reaches the end-of-stroke position (FIGS. 2 and 4), the intake valve then being closed.

When the user releases the pressure P on the pusher, the compression spring 17 pushes the actuating tube 21 toward the rest position and, owing to the difference in frictional forces, the actuating tube 21 slides relative to the piston 25 until the central sleeve 26 comes into contact with the base 30 and closes the exhaust valve 33. Next, the rise of the stem 20 is accompanied by the rise of the piston 25 in the body 1 and therefore an increase in the volume of the metering chamber 2. A partial vacuum is created in the metering chamber 2, thereby causing the intake valve to open, the ball 10 being moved away from the seat 11, and the product is sucked into the metering chamber 2.

In other embodiments, provision may be made for the exhaust valve 33 to be opened and closed by means of an elastic member, such as a precompression spring, especially in the presence of a low-viscosity fluid product, this spring furthermore bearing at the top, on the one hand, on the stem 20, for example against a shoulder, and, on the other hand, bearing at the bottom against the piston 25, and to do so so that it is necessary that a certain pressure be reached in the metering chamber 2 in order for the exhaust valve 33 to open.

In a priming phase, the displacement of the stem 20 from the rest position toward the end-of-stroke position makes it possible, when the metering chamber 2 is filled with air, before the first use, to expel the air in order to replace it with fluid product.

To ensure that the pump is rapidly primed and to improve the suction capabilities of the pump, the base 30 has a filling member 40, for example made as one piece with the free end of the collar 32. The filling member 40 may be designed to occupy a dead volume of the metering chamber 2, for example between the central sleeve 26 and the bushing 27. It is also possible to provide for the filling member 40 to be designed to bear against the inner surface of the bushing 27 in the rest position in order to improve the sealing of the pump.

What is claimed is:

1. A range of pumps comprising at least first and second pumps designed to dispense respectively first and second doses of fluid product, said first and second doses of fluid product having different first and second volumes respectively, each of the first and second pumps comprising:

a tubular body extending along a central axis between a first end and a second end and including an intake orifice near the first end;

an end member having a central opening and associated with the second end of the body, the end member having a tubular wall that extends along the central axis, the tubular wall having an outer surface and an inner surface extending along the central axis between opposite free ends of the end member, the inner surface defining the central opening, the end member including a rest abutment and an end-of-stroke abutment, said end-of-stroke abutment being formed by a shoulder provided on the inner surface of the end member, between the free ends of said end member;

a compression member mounted so as to move inside the body along an axial stroke between a rest position, away from the intake orifice and in which said compression member is in abutment against the rest abutment, and an end-of-stroke position, close to the intake orifice and in which said compression member is in abutment against the end-of-stroke abutment, said compression member being elastically returned toward the rest position and including a stem extending in the central opening of the end member, a piston sliding inside the body and an exhaust orifice, the stem having a collar that can move in the end member facing the inner surface of said end member, the collar being adapted to be in abutment against the shoulder in the end-of-stroke position;

a metering chamber formed between the intake orifice and the exhaust orifice and delimited by the body and the compression member; and an intake valve and an exhaust valve adapted to selectively close off the intake orifice and the exhaust orifice, respectively;

the first and second pumps differing from each other only in that the respective shoulders forming the end-of-stroke abutments of the end members of the first and second pumps are located at first and second distances from the respective intake orifices, said first and second distances being different from each other.

2. The range of pumps according to claim 1, in which the stem of each of the first and second pumps is adapted to be in abutment directly against the end-of-stroke abutment in the end-of-stroke position.

3. The range of pumps according to claim 1, in which the end member of each of the first and second pumps includes a tubular skirt fitted inside the body and having a free end that forms the rest abutment, the piston being in abutment directly against the free end of the skirt in the rest position.

4. The range of pumps according to claim 3, in which the skirt includes an axial end zone that has the free end and is radially offset toward the inside of the body, the piston having an annular groove in which the end zone is placed in sealed contact in the rest position.

* * * * *